US010199033B1

(12) United States Patent
Yano

(10) Patent No.: US 10,199,033 B1
(45) Date of Patent: Feb. 5, 2019

(54) ACTIVE NOISE CONTROL APPARATUS

(71) Applicant: Mitsubishi Electric Corporation, Tokyo (JP)

(72) Inventor: Atsuyoshi Yano, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 0 days.

(21) Appl. No.: 16/065,008

(22) PCT Filed: Feb. 9, 2016

(86) PCT No.: PCT/JP2016/053820
§ 371 (c)(1),
(2) Date: Jun. 21, 2018

(87) PCT Pub. No.: WO2017/138094
PCT Pub. Date: Aug. 17, 2017

(51) Int. Cl.
*G10K 11/16* (2006.01)
*H04R 3/00* (2006.01)
*G10K 11/178* (2006.01)

(52) U.S. Cl.
CPC .... *G10K 11/1781* (2018.01); *G10K 11/17854* (2018.01); *G10K 11/17881* (2018.01);
(Continued)

(58) Field of Classification Search
CPC ..... G10K 11/178; G10K 11/1781; G10K 11/1785; G10K 11/17854;
(Continued)

(56) References Cited

U.S. PATENT DOCUMENTS 5,524,057 A * 6/1996 Akiho ..... G10K 11/178 381/94.7
7,620,188 B2 * 11/2009 Inoue ..... G10K 11/178 123/192.1
(Continued)

FOREIGN PATENT DOCUMENTS

JP 2009-241672 A 10/2009
JP WO2014/128856 A1 10/2009
(Continued)

*Primary Examiner* — Thang V Tran
(74) *Attorney, Agent, or Firm* — Birch, Stewart, Kolasch & Birch, LLP

(57) ABSTRACT

An active noise control apparatus (100) includes: a sound source signal generating unit (1) generating a sound source signal from a control frequency determined in accordance with a noise source (400); a control signal filter (2) generating an original control signal by filtering the sound source signal; a stabilization processing unit (5) generating a control signal by filtering the original control signal to allow a signal in a frequency band including the control frequency to pass through, and to block a signal in a frequency band including disturbance added to the noise; a reference signal filter (3) generating a reference signal by filtering the sound source signal. The apparatus further includes: a filter coefficient updating unit (4) updating a filter coefficient sequence of the control signal filter using an error signal being an interference between a secondary noise generated from the control signal and the noise, and the reference signal.

6 Claims, 7 Drawing Sheets

(52) U.S. Cl.
CPC ..... *G10K 2210/3028* (2013.01); *G10K 2210/3054* (2013.01)

(58) Field of Classification Search
CPC ..... G10K 11/17881; G10K 11/17883; G10K 2210/3028; G10K 2210/3054; G10L 21/0208; H04R 3/00; H04R 3/02; H04R 2460/01; H04R 1/1083; H04R 25/505
See application file for complete search history.

(56) References Cited

U.S. PATENT DOCUMENTS 8,150,055 B2 * 4/2012 Sakamoto ..... G10K 11/1784 381/71.1
8,254,589 B2 * 8/2012 Mitsuhata ..... G10K 11/178 381/71.1
8,600,069 B2 * 12/2013 Lee ..... H04S 7/00 381/71.11
8,817,998 B2 * 8/2014 Inoue ..... G10K 11/178 381/71.9
9,484,010 B2 * 11/2016 Nohara ..... G10K 11/17883
2007/0038441 A1 * 2/2007 Inoue ..... G10K 11/178 704/226
2007/0233478 A1 * 10/2007 Sakamoto ..... G10K 11/178 704/233
2012/0195439 A1 8/2012 Ohta et al.
2013/0136270 A1 * 5/2013 Sakamoto ..... G10K 11/16 381/71.4
2013/0195282 A1 * 8/2013 Ohita ..... H04R 3/002 381/71.2
2014/0126739 A1 5/2014 Yano
2015/0356966 A1 12/2015 Yano
2016/0012815 A1 * 1/2016 Yano ..... G10K 11/17833 381/71.11
2017/0229111 A1 * 8/2017 Hanazono ..... G10K 11/178

FOREIGN PATENT DOCUMENTS

JP WO2011/042960 A1 4/2011
JP 2013-71535 A 4/2013
JP WO2013/108294 A1 7/2013

* cited by examiner

ACTIVE NOISE CONTROL APPARATUS

TECHNICAL FIELD

The present invention relates to an active noise control apparatus that generates vibration or noise to cancel out vibration or noise which, for example, machinery generates, thereby reducing the vibration or noise.

BACKGROUND ART

A conventional active noise control apparatus detects noise which is a control target by using a detecting means such as a microphone or various types of sensors, and outputs a control sound having the same amplitude and the inverted phase to cancel out the noise, thereby silencing the noise.

In the present invention, vibration or noise which machinery generates is collectively referred to as noise.

Further, some of conventional active noise control apparatuses include an error microphone placed at a desired position, and perform a control to keep the silencing effect to be maximum by correcting the control sound on the basis of a signal from the error microphone. At this time, when disturbance unrelated to noise is collected by the error microphone, the active noise control apparatus operates in such a way as to silence the sound including the disturbance. As a result, the effect of silencing the originally targeted noise may be lost temporarily, or the control sound may become abnormal noise. As examples of such disturbance, for example, there are a blowing sound which is caused by wind hitting the error microphone, a strike sound which is caused by a person or an object touching the error microphone, and so on.

To solve this problem, for example, Patent Literature 1 discloses a method of avoiding an occurrence of abnormal noise by reducing a control sound using a muting process. Further, Patent Literature 2 discloses a method of, in an active noise control apparatus that adjusts a control sound by using an adaptive notch filter, stabilizing a silencing effect by adjusting a step size which is a parameter for controlling an amount of updating of a filter coefficient.

CITATION LIST

Patent Literature

Patent Literature 1: Japanese Unexamined Patent Application Publication No. 2013-71535

Patent Literature 2: Japanese Unexamined Patent Application Publication No. 2009-241672

SUMMARY OF INVENTION

Technical Problem

As disturbance which is collected by an error microphone, in addition to an extremely strong disturbance described in the above example, there always exists a background sound such as a sound which is a person's voice or which is generated by a person's behavior, other environmental noise, or the like. In a case where disturbance having a low strength, such as a background sound, is collected by an error microphone, a problem in which a remarkable abnormal noise such as a roar occurs or the silencing effect is impaired greatly does not arise, but a certain degree of abnormal noise component may be generated in the control sound. There is a case in which an abnormal noise component caused by disturbance of low strength has a level which is not remarkable, but is enough to be able to be perceived, and may become a cause to bring about an unpleasant feeling to the user. Particularly, in the vicinity of a speaker for reproducing the control sound, such abnormal noise is perceived in many cases.

In a case of using the method disclosed in above-mentioned Patent Literature 1 for disturbance having a low strength, the control sound is muted constantly and the effect of silencing noise is lost fundamentally.

Also in a case of using the method disclosed in above-mentioned Patent Literature 2 for disturbance having a low strength, since the step size is suppressed constantly, the ability to follow a change in noise is lost.

As described above, a problem with conventional active noise control apparatuses is that it is difficult to suppress abnormal noise caused by disturbance such as a background sound which is mixedly collected by the error microphone without impairing the effect of silencing noise.

The present invention is made in order to solve the above problem, and it is therefore an object of the present invention to provide a technique for suppressing abnormal noise caused by disturbance without impairing the effect of silencing noise.

Solution to Problem

According to the present invention, an active noise control apparatus includes: a sound source signal generating unit generating a sound source signal on a basis of a control frequency which is determined in accordance with a noise source emitting noise; a control signal filter generating an original control signal by performing a filtering process on the sound source signal; a stabilization processing unit generating a control signal by performing a filtering process on the original control signal to allow a signal in a frequency band including the control frequency to pass through, and to block a signal in a frequency band including disturbance added to the noise; a reference signal filter generating a reference signal by performing a filtering process on the sound source signal; and a filter coefficient updating unit updating a filter coefficient sequence of the control signal filter by using an error signal which is acquired as a result of interference between a secondary noise which is generated on a basis of the control signal and the noise, and the reference signal.

Advantageous Effects of Invention

According to the present invention, since the filtering process of allowing a signal in a frequency band including the control frequency to pass through, and blocking a signal in a frequency band including the disturbance added to noise is performed for the signal included in the original control signal to generate the control signal. Consequently, the control signal can be stabilized against disturbance, while a frequency component effective for the noise is prevented from being reduced from the control signal. Therefore, abnormal noise caused by disturbance can be suppressed without impairing the effect of silencing the noise.

DESCRIPTION OF EMBODIMENTS

Hereafter, in order to explain the present invention in more detail, some embodiments of the present invention will be described with reference to the accompanying drawings.

Embodiment 1

Figure 1:
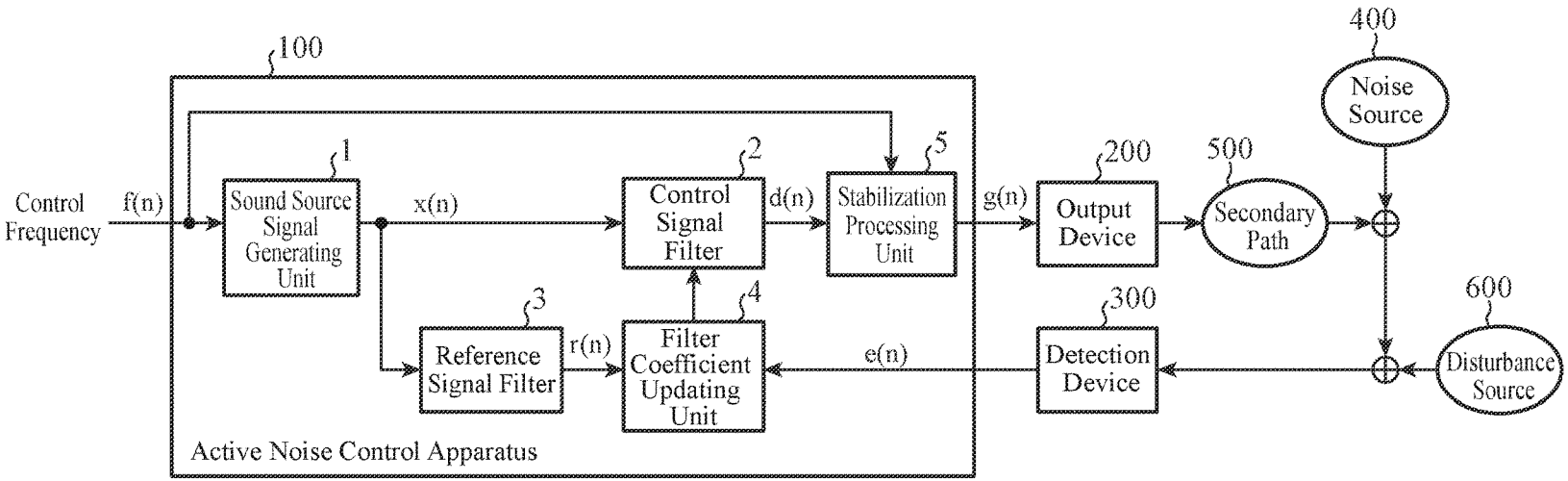
FIG. 1 is a block diagram showing the configuration of an active noise control apparatus according to Embodiment 1 of the present invention.

FIG. 1 is a block diagram showing the configuration of an active noise control apparatus 100 according to Embodiment 1 of the present invention. As illustrated in the drawing, an output device 200 and a detection device 300 which are disposed outside are connected to the active noise control apparatus 100.

The active noise control apparatus 100 receives a control frequency f(n) for noise emitted by a noise source 400 which is a control target, and outputs a control signal g(n) which is generated on the basis of the control frequency f(n) inputted thereto. Here, n represents a positive integer and shows a sampling time in digital signal processing. In a case in which, for example, the noise source 400 is the engine of a vehicle, the control frequency f(n) can be acquired by using a method of measuring the rotational frequency of the engine on the basis of the period of the ignition pulse, and multiplying this rotational frequency by a constant in accordance with the noise which is the control target, or the like. In a case in which the noise source 400 is a fan driven by an electric motor, the control frequency f(n) for an NZ noise which is a control target can be calculated on the basis of the number of poles of the electric motor and the power supply frequency, the number of blades of the fan, and so on. Namely, the control frequency f(n) can be acquired by using a means suitable for the noise source 400 which is the target.

The output device 200 converts the control signal g(n) inputted from the active noise control apparatus 100 into a secondary noise for cancelling out the noise emitted from the noise source 400, and outputs the secondary noise. This output device 200 can be implemented by, for example, a speaker or an actuator.

The secondary noise outputted from the output device 200 propagates through a secondary path 500 and interferes with the noise emitted from the noise source 400, thereby reducing the noise. The noise which is reduced by the interference with the secondary noise is referred to as the remaining noise or the error. Here, the secondary path 500 is defined as the path through which the secondary noise outputted from the output device 200 passes to propagate to the detection device 300. Further, disturbance source 600 further adds unspecific disturbance which is unrelated to the noise source 400 to the remaining noise. This disturbance includes an extremely strong disturbance such as a blowing sound or a strike sound, and disturbance having a low strength such as a background sound.

The detection device 300 detects an error with disturbance in which disturbance is added to the error which is the remaining noise generated by the interference between the noise and the secondary noise, and outputs, as an error signal e(n), the error with disturbance detected thereby to the active noise control apparatus 100. The detection device 300 can be typically implemented by a microphone.

Next, the details of the configuration of the active noise control apparatus 100 will be explained. The active noise control apparatus 100 includes a sound source signal generating unit 1, a control signal filter 2, a reference signal filter 3, a filter coefficient updating unit 4, and a stabilization processing unit 5.

The sound source signal generating unit 1 generates a sound source signal x(n) on the basis of the control frequency f(n) inputted to the active noise control apparatus 100. The sound source signal generating unit 1 outputs the sound source signal x(n) generated thereby to the control signal filter 2 and the reference signal filter 3.

The control signal filter 2 performs a filtering process on the sound source signal x(n) from the sound source signal generating unit 1, and outputs an original control signal d(n). The control signal filter 2 outputs the original control signal d(n) to the stabilization processing unit 5. Here, a control filter coefficient sequence W(n) which the control signal filter 2 uses when performing the filtering process is updated by the filter coefficient updating unit 4 which will be described later.

The reference signal filter 3 performs a filtering process on the sound source signal x(n) from the sound source signal generating unit 1 by using a transfer characteristic parameter which is determined on the basis of the transfer characteristics of the secondary path 500, and as a result of the filtering process, outputs a reference signal r(n). The reference signal filter 3 outputs the reference signal r(n) to the filter coefficient updating unit 4.

The filter coefficient updating unit 4 updates the control filter coefficient sequence W(n) of the control signal filter 2 on the basis of the reference signal r(n) from the reference signal filter 3, the error signal e(n) from the detection device 300, and a predetermined step size. The filter coefficient updating unit 4 can use an adaptation algorithm, such as the LMS (Least Mean Square), the NLMS (Normalized Least Mean Square), or the RLS (Recursive Least Square), for the update of the control filter coefficient sequence W(n). The predetermined step size is a value determined heuristically by experiment or the like, and is preset to the filter coefficient updating unit 4.

As an alternative, the filter coefficient updating unit 4 may calculate a coefficient update value, and the control signal filter 2 may update the control filter coefficient sequence W(n) by adding the coefficient update value to the control filter coefficient sequence W(n).

The stabilization processing unit 5 generates a stabilized control signal g(n) by performing a stabilizing process by correcting the original control signal d(n) from the control signal filter 2 on the basis of the control frequency f(n) inputted to the active noise control apparatus 100. The stabilization processing unit 5 outputs the control signal g(n) to the output device 200. The control signal g(n) is converted into a secondary noise for reducing noise, which will be described in detail later.

Figure 2:
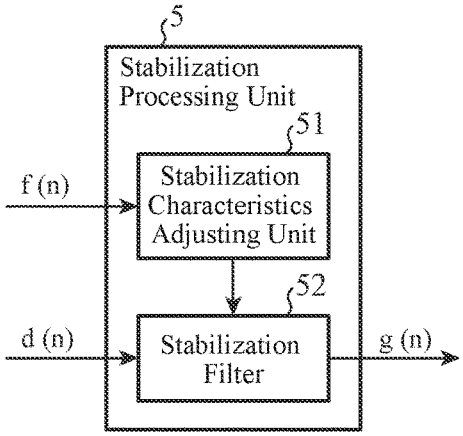
FIG. 2 is a block diagram showing the configuration of a stabilization processing unit in the active noise control apparatus according to Embodiment 1.

FIG. 2 is a block diagram showing the internal configuration of the stabilization processing unit 5 in the active noise control apparatus 100 according to Embodiment 1. As illustrated in the drawing, the stabilization processing unit 5 according to Embodiment 1 includes a stabilization characteristics adjusting unit 51 and a stabilization filter 52.

The stabilization characteristics adjusting unit 51 adjusts the filter characteristics of the stabilization filter 52 in such a way that the stabilization filter allows a signal in a frequency band including the control frequency f(n) to pass therethrough, and blocks a signal in the other frequency band. An instruction for adjusting the filter characteristics is sent from the stabilization characteristics adjusting unit 51 to the stabilization filter 52.

The stabilization filter 52 performs a filtering process on the original control signal d(n) from the control signal filter 2, and outputs a control signal g(n) as a result of the filtering process. The stabilization filter 52 adjusts the filter characteristics in accordance with the instruction from the stabilization characteristics adjusting unit 51.

Figure 3:
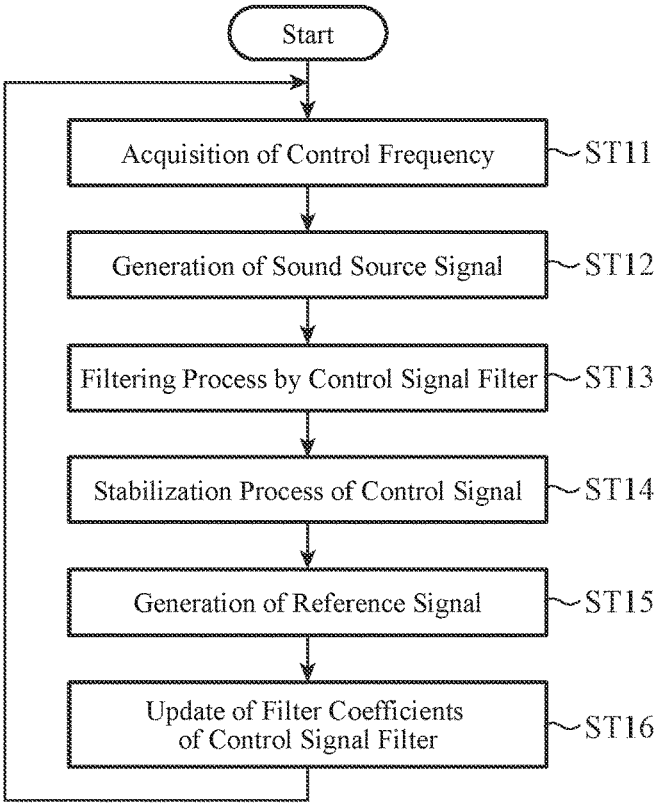
FIG. 3 is a flowchart showing the operation of the active noise control apparatus according to Embodiment 1.

Next, the operation of the active noise control apparatus 100 according to Embodiment 1 will be explained. FIG. 3 is a flowchart showing the operation of the active noise control apparatus 100 according to Embodiment 1. The order of processes performed by the active noise control apparatus 100 according to Embodiment 1 is not limited to that shown in the flow chart of FIG. 3, and the processes can be performed in a different order and a part of the processes can be performed in parallel as long as an equivalent result can be acquired.

A control frequency f(n) showing the frequency of noise is inputted to the sound source signal generating unit 1 and the stabilization processing unit 5 in the active noise control apparatus 100. As described before, n represents a positive integer, and shows a sampling time in the digital signal processing.

In step ST11, the sound source signal generating unit 1 acquires the control frequency f(n).

In step ST12, the sound source signal generating unit 1 generates a sound source signal x(n) corresponding to the control frequency f(n), and outputs the sound source signal x(n) to the control signal filter 2 and the reference signal filter 3. Here, in a case in which the active noise control apparatus 100 uses, for example, an adaptive notch filter, signals of two series: a sine wave signal and a cosine wave signal which correspond to the control frequency f(n) are included in the sound source signal x(n). A preferred example of such a sound source signal generating method is disclosed by, for example, WO2013/108294.

In step ST13, the control signal filter 2 performs a filtering process on the sound source signal x(n) outputted from the sound source signal generating unit 1 by using the control filter coefficient sequence W(n), and outputs an original control signal d(n) to the stabilization processing unit 5. Here, the control filter coefficient sequence W(n) is the first or higher order filter coefficient sequence.

Further, when the sound source signal x(n) includes signals of two series: a sine wave signal and a cosine wave signal, the control filter coefficient sequence W(n) also includes a filter coefficient sequence for the sine wave signal, and a filter coefficient sequence for the cosine wave signal. The control signal filter 2 then determines, as the original control signal d(n), a signal which is obtained by adding the filtering process result using the filter coefficient sequence for the sine wave signal, and the filtering process result using the filter coefficient sequence for the cosine wave signal.

In step ST14, the stabilization processing unit 5 performs a stabilizing process corresponding to the control frequency f(n) on the original control signal d(n) outputted from the control signal filter 2, thereby generating a control signal g(n) which is stabilized by removing abnormal noise component occurred by the influence of disturbance. The stabilization processing unit 5 outputs the generated control signal g(n) to the output device 200. The details of the operation of the stabilization processing unit 5 which is performed at this time will be described later.

The output device 200 converts the control signal g(n) outputted from the stabilization processing unit 5 into a secondary noise, and outputs the secondary noise. The secondary noise outputted from the output device 200 propagates through the secondary path 500, and interferes with the noise emitted from the noise source 400 after being influenced by the transfer characteristics of the secondary path 500 during the propagation, thereby reducing the noise.

Disturbance from the disturbance source 600 is further added to the reduced noise.

The detection device 300 detects the result of the addition of the noise, the secondary noise, and the disturbance, i.e., an error with disturbance in which the disturbance is added to the remaining noise, thereby generating an error signal e(n). The error signal e(n) generated by the detection device 300 is inputted to the filter coefficient updating unit 4 in the active noise control apparatus 100.

In step ST15, the reference signal filter 3 performs a filtering process on the sound source signal x(n) outputted from the sound source signal generating unit 1 by using a reference filter coefficient sequence C having the transfer characteristics of the secondary path 500, and outputs a reference signal r(n) to the filter coefficient updating unit 4. Here, the reference filter coefficient sequence C is the first or higher order.

Further, when the sound source signal x(n) includes signals of two series: a sine wave signal and a cosine wave signal, the reference filter coefficient sequence C also includes a filter coefficient sequence for the sine wave signal, and a filter coefficient sequence for the cosine wave signal. In this case, signals of two series: a signal which is a result of the filtering process using the filter coefficient sequence for the sine wave signal, and a signal which is a result of the filtering process using the filter coefficient sequence for the cosine wave signal are included in the reference signal r(n).

In step ST16, the filter coefficient updating unit 4 successively updates the value of the control filter coefficient sequence W(n) of the control signal filter 2 on the basis of the reference signal r(n) outputted from the reference signal filter 3, the error signal e(n) outputted from the detection device 300, and the predetermined step size in such a way that the remaining noise included in the error signal e(n) is reduced. Here, for example, a well-known algorithm, such as the LMS, NLMS, or RLS, can be used.

At this time, when disturbance from the disturbance source 600 is included in the error signal e(n), the filter coefficient updating unit 4 updates the control filter coefficient sequence W(n) in such a way that the disturbance, as well as the noise which is the target, is also reduced. However, in many cases, the sound source signal x(n) and the disturbance are unrelated to each other. Further, there is no linear shift invariant filter that receives the sound source signal x(n) and outputs the control signal g(n) reducing the disturbance. Therefore, the control filter coefficient sequence W(n) which is updated in such a way that the disturbance included in the error signal e(n) at the time n is reduced is no longer effective for disturbance at a time when the secondary noise, in which the updated control filter coefficient sequence W(n) is reflected, is outputted from the output device 200. Namely, in the updated control filter coefficient sequence W(n), the component caused by the disturbance is only an admixture which contributes to neither a reduction of the noise which is the target for the active noise control apparatus 100, nor a reduction of the disturbance. However, the admixture component causes the original control signal d(n) outputted by the control signal filter 2 to become unstable, thereby causing abnormal noise component to occur.

To solve this problem, the stabilization processing unit 5 changes the original control signal to a stabilized control signal g(n) by removing the abnormal noise component from the original control signal d(n), and outputs the stabilized control signal g(n) to the output device 200. As a result of this process, the influence of the disturbance is suppressed without the processes performed in conventional techniques such as muting the control signal g(n) itself, or suppressing the step size of the filter coefficient updating unit 4.

The stabilization characteristics adjusting unit 51 adjusts the filter characteristics of the stabilization filter 52 in such a way that the stabilization filter allows a signal in a frequency band including the control frequency f(n) and having a predetermined bandwidth to pass therethrough and blocks a signal in the other frequency band. For example, a case may be considered in which the stabilization filter 52 is provided with either of the following characteristics: low-pass characteristics of blocking a signal in a frequency band which is higher than the control frequency f(n) by a predetermined frequency or more, high-pass characteristics of blocking a signal in a frequency band which is lower than the control frequency f(n) by the predetermined frequency or more, and bandpass characteristics having both the low-pass characteristics and the high-pass characteristics. The predetermined frequency is preset to the stabilization characteristics adjusting unit 51. This predetermined frequency is set as a safety margin for preventing influence of the stabilization filter 52 on a signal having the control frequency f(n), and the value of the predetermined frequency is determined experientially.

It is assumed hereafter that the stabilization filter 52 holds, in advance, plural filter coefficient sequences having different band pass characteristics, and the stabilization characteristics adjusting unit 51 selects a filter coefficient sequence corresponding to the control frequency f(n) from among the plural filter coefficient sequences and instructs the stabilization filter 52 to use the selected filter coefficient sequence.

Figure 4:
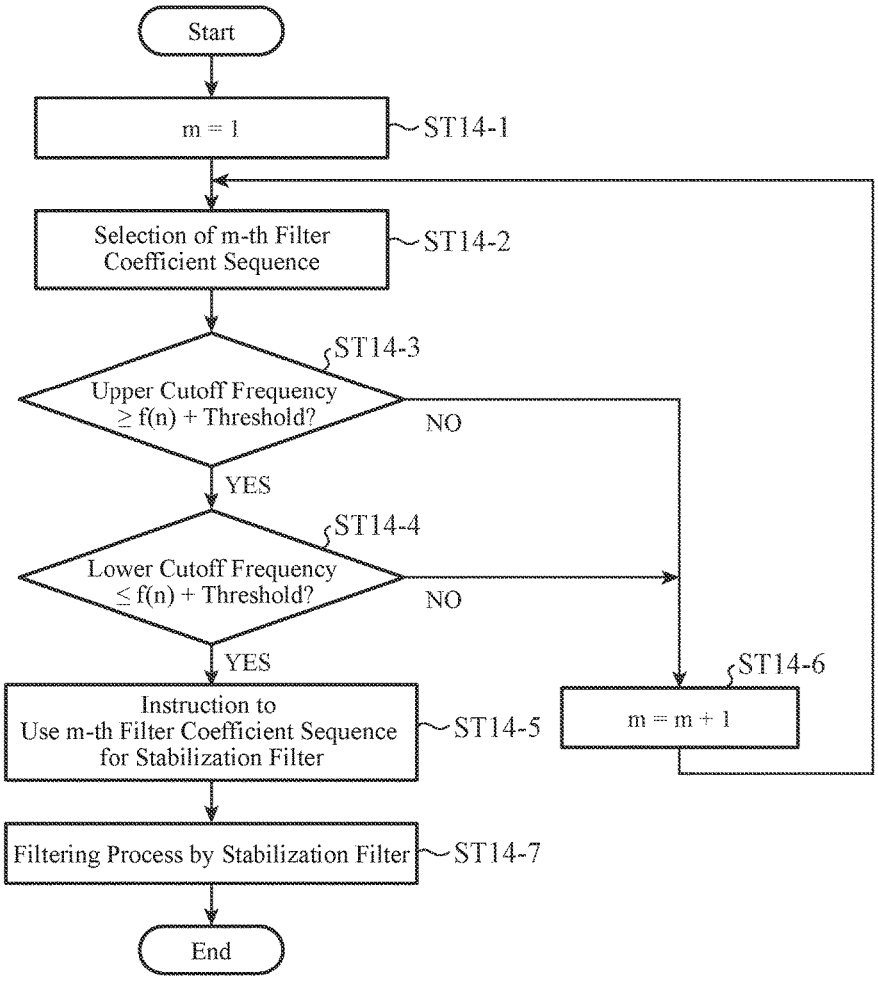
FIG. 4 is a flowchart showing the operation of the stabilization processing unit in the active noise control apparatus according to Embodiment 1.

FIG. 4 is a flowchart showing the operation of the stabilization processing unit 5 in the active noise control apparatus 100 according to Embodiment 1. Processes shown in the flowchart of FIG. 4 are performed in step ST14 in the flowchart of FIG. 3.

Hereafter, a method of selecting a filter coefficient sequence corresponding to the control frequency f(n) from among M filter coefficient sequences having different bandpass characteristics will be explained as an example. It is assumed that each of the M filter coefficient sequences held by the stabilization filter 52 is specified by the number m.

In step ST14-1, the stabilization characteristics adjusting unit 51 sets m=1 first as the filter coefficient sequence number.

In step ST14-2, the stabilization characteristics adjusting unit 51 selects the m-th filter coefficient sequence.

In step ST14-3, the stabilization characteristics adjusting unit 51 determines whether or not an upper cutoff frequency in the filter characteristics of the m-th filter coefficient sequence is higher than the control frequency f(n) by a predetermined threshold or more. Here, it is assumed that the upper cutoff frequency refers to a certain frequency, the gain becoming equal to or less than a predetermined value when the frequency of the signal becomes higher than the certain frequency. Here, the predetermined threshold is the same as the above-mentioned predetermined frequency.

When the upper cutoff frequency is higher than the control frequency f(n) by the predetermined threshold or more (when "YES" in step ST14-3), the stabilization characteristics adjusting unit 51 advances to step ST14-4; otherwise (when "NO" in step ST14-3), the stabilization characteristics adjusting unit 51 advances to step ST14-6.

In step ST14-4, the stabilization characteristics adjusting unit 51 determines whether or not a lower cutoff frequency in the filter characteristics of the m-th filter coefficient sequence is lower than the control frequency f(n) by a predetermined threshold or more. Here, it is assumed that the lower cutoff frequency refers to a certain frequency, the gain becoming equal to or less than a predetermined value when the frequency of the signal becomes lower than the certain frequency.

When the lower cutoff frequency is lower than the control frequency f(n) by the predetermined threshold or more (when "YES" in step ST14-4), the stabilization characteristics adjusting unit 51 advances to step ST14-5; otherwise (when "NO" in step ST14-4), the stabilization characteristics adjusting unit 51 advances to step ST14-6.

In step ST14-5, the stabilization characteristics adjusting unit 51 instructs the stabilization filter 52 to use the m-th filter coefficient sequence currently selected.

In step ST14-6, the stabilization characteristics adjusting unit 51 updates the value of min such a way that the value is incremented as represented by m=m+1, and returns to step ST14-2.

Here, it is assumed that the M filter coefficient sequences are provided to the stabilization filter 52 in such a way that one or more filter coefficient sequences which satisfy the conditions in steps ST14-3 and ST14-4 certainly exist for any control frequency f(n).

In step ST14-7, the stabilization filter 52 performs a filtering process on the original control signal d(n) by using the filter coefficient sequence which the stabilization filter is instructed to use by the stabilization characteristics adjusting unit 51, and outputs a control signal g(n). Due to the filter characteristics which the stabilization filter 52 is instructed to have by the stabilization characteristics adjusting unit 51, a signal in a frequency band including the control frequency f(n) is passed through the filter and a signal in the other frequency band is blocked, so that the abnormal noise component caused by the influence of the disturbance is removed.

Next, the hardware configuration of the active noise control apparatus 100 will be explained.

Each of the functions of the sound source signal generating unit 1, the control signal filter 2, the reference signal filter 3, the filter coefficient updating unit 4, and the stabilization processing unit 5 in the active noise control apparatus 100 can be implemented by either hardware for dedicated use which employs an ASIC (Application Specific Integrated Circuit) or the like, or a processor that executes a program stored in a memory. As an alternative, each of the functions can be implemented by a combination of hardware, such as an electronic circuit or an LSI (Large Scale Integration), and a processor that executes a program stored in a memory.

Figure 5:
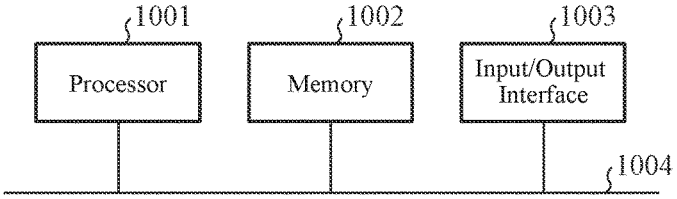
FIG. 5 is a hardware block diagram of the active noise control apparatus according to Embodiment 1.

FIG. 5 is a block diagram showing an example of the hardware configuration of the active noise control apparatus 100 according to Embodiment 1 in a case in which the active noise control apparatus 100 is implemented by a processor 1001 that executes a program stored in a memory 1002. Each of active noise control apparatuses 100 and 101 according to Embodiments 2 and 3 which will be described later also has the same basic hardware configuration as that shown in FIG. 5.

Each of the functions of the sound source signal generating unit 1, the control signal filter 2, the reference signal filter 3, the filter coefficient updating unit 4, and the stabilization processing unit 5 in the active noise control apparatus 100 is implemented by software, firmware, or a combination of software and firmware. The software or the firmware is described as a program and is stored in the memory 1002. The processor 1001 implements the function of each of the units by reading out and executing a program stored in the memory 1002. Namely, the active noise control apparatus 100 includes the memory 1002 for storing programs, and when the programs are executed by the processor 1001, the steps shown in FIGS. 3 and 4 are performed as a result. Further, it can be said that the program causes a computer to execute a procedure or method corresponding to the following units: the sound source signal generating unit 1, the control signal filter 2, the reference signal filter 3, the filter coefficient updating unit 4, and the stabilization processing unit 5.

Further, the input of the control frequency f(n) from external equipment to the active noise control apparatus 100, the output of the control signal g(n) from the active noise control apparatus 100 to the output device 200, the input of the error signal e(n) from the detection device 300 to the active noise control apparatus 100, and so on are performed via an input/output interface 1003. One or more input/output interfaces 1003 can be disposed correspondingly to equipment to be connected.

A bus 1004 connects the processor 1001, the memory 1002, and the input/output interface 1003. The bus 1004 can be constituted using a bus bridge or the like as appropriate.

Further, each of the control signal filter 2, the reference signal filter 3, and the stabilization filter 52 can be implemented by an analog filter or a digital filter.

Hereafter, an example of the configuration of each of the filters will be explained by taking the stabilization filter 52 as an example. In a case in which the stabilization filter 52 is constituted by an analog filter, a variable resistive element is disposed in the circuit, and the filter characteristics are adjusted by dynamically changing the value of its resistance in accordance with an instruction from the stabilization characteristics adjusting unit 51. In a case in which the stabilization filter 52 is constituted by a digital filter, it is constituted by a filter such as the FIR (Finite Impulse Response) filter or the IIR (Infinite Impulse Response) filter, and the filter characteristics are adjusted by changing the filter coefficient of the stabilization filter in accordance with an instruction from the stabilization characteristics adjusting unit 51. Further, in any of the cases: the case in which the stabilization filter is constituted by an analog filter, and the case in which the stabilization filter is constituted by a digital filter, the dynamic adjustment of the filter characteristics may be implemented using the following means. Namely, the stabilization filter 52 is constituted by plural filters whose passbands are different frequency bands, respectively. One output from among the outputs of the respective filters for the original control signal d(n) is selected by a selector on the basis of the instruction from the stabilization characteristics adjusting unit 51, thereby realizing the dynamic adjustment of the filter characteristics. Alternatively, by mixing the outputs by a mixer after applying appropriate gains to the outputs of the respective filters, the dynamic adjustment of the filter characteristics can also be realized.

As described above, the active noise control apparatus 100 according to Embodiment 1 is configured to include: a sound source signal generating unit 1 generating a sound source signal x(n) on a basis of a control frequency f(n) which is determined in accordance with a noise source 400 emitting noise; a control signal filter 2 generating an original control signal d(n) by performing a filtering process on the sound source signal x(n); a stabilization processing unit 5 generating a control signal g(n) by performing a filtering process on the original control signal d(n) to allow a signal in a frequency band including the control frequency f(n) to pass through, and to block a signal in a frequency band including disturbance added to the noise; a reference signal filter 3 generating a reference signal r(n) by performing a filtering process on the sound source signal x(n); and a filter coefficient updating unit 4 updating a filter coefficient sequence W(n) of the control signal filter 2 by using an error signal e(n) which is acquired as a result of interference between a secondary noise which is generated on a basis of the control signal g(n) and the noise, and the reference signal r(n). With this configuration, an abnormal noise component included in the control signal g(n), the abnormal noise component caused by disturbance, can be removed, while a frequency component effective for the noise is prevented from being reduced from the control signal g(n). Therefore, the abnormal noise caused by disturbance can be suppressed without impairing the effect of silencing the noise.

Further, according to Embodiment 1, instead of suppressing the step size of the filter coefficient updating unit 4, the stabilization processing unit 5 is configured to perform a stabilizing process on the original control signal d(n). Consequently, degradation in the following ability of the control signal g(n) to the noise can be prevented.

Embodiment 2

The active noise control apparatus 100 according to Embodiment 1 removes abnormal noise by performing a filtering process on the control signal g(n) by using the stabilization filter 52. In this process, a delay caused by the group delay characteristics of the stabilization filter 52 is provided for the control signal g(n). The delay caused by the group delay characteristics is added to the time delay between the time when the filter coefficient updating unit 4 updated the control filter coefficient sequence W(n) and the time when the filter coefficient updating unit 4 receives the error signal e(n) in which the result of the update is reflected. Therefore, when the delay caused by the group delay characteristics is long, the delay becomes a cause of degradation in the ability to follow a change in noise. To solve this problem, in Embodiment 2, instead of processing the control signal g(n) by using the stabilization filter 52, a filtering process is performed on an update value of the control filter coefficient sequence W(n). As a result, an abnormal noise component is removed without providing a delay for the control signal g(n).

Figure 6:
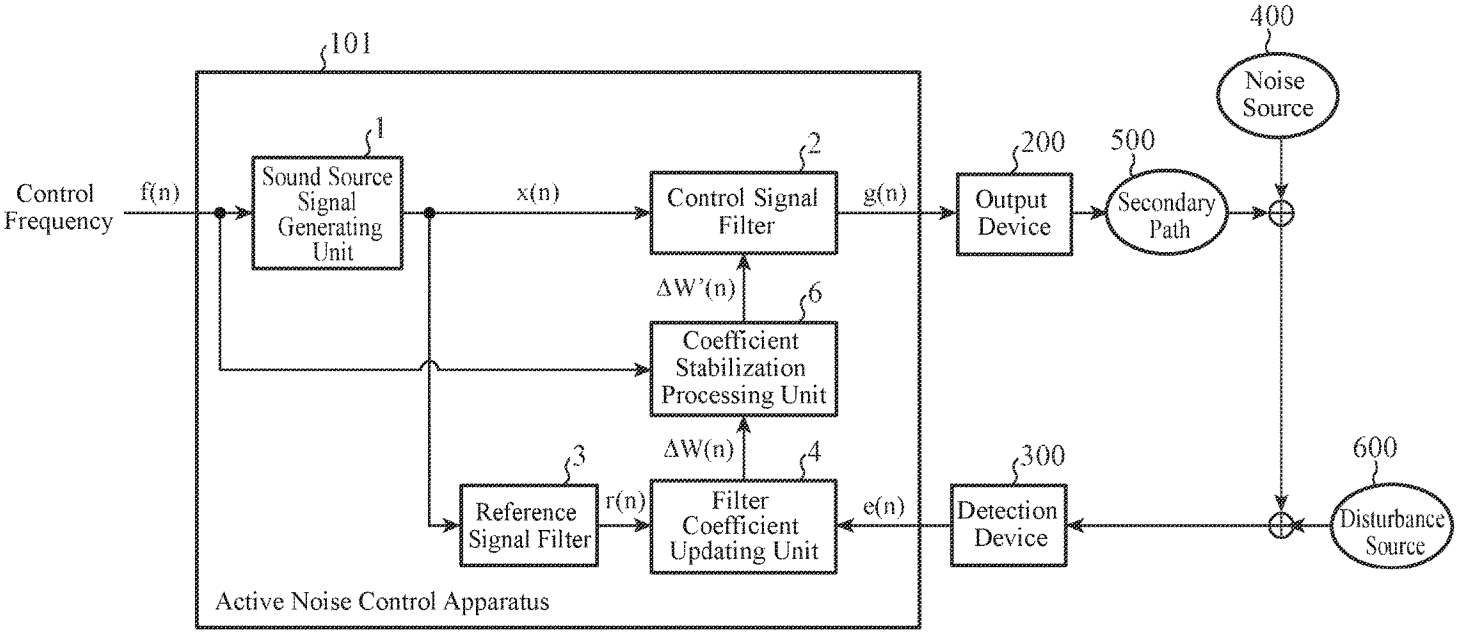
FIG. 6 is a block diagram showing the configuration of an active noise control apparatus according to Embodiment 2 of the present invention.

FIG. 6 is a block diagram showing the configuration of an active noise control apparatus 101 according to Embodiment 2 of the present invention. The active noise control apparatus 101 according to Embodiment 2 has a configuration in which a coefficient stabilization processing unit 6 is added instead of the stabilization processing unit 5 in the active noise control apparatus 100 according to Embodiment 1 shown in FIG. 1. In FIG. 6, the same or corresponding components as those shown in FIG. 1 are denoted by the same reference numerals, and the explanation of the components will be omitted hereafter.

Next, the details of the configuration of the active noise control apparatus 101 will be explained. The active noise control apparatus 101 includes a sound source signal generating unit 1, a control signal filter 2, a reference signal filter 3, a filter coefficient updating unit 4, and the coefficient stabilization processing unit 6.

The filter coefficient updating unit 4 is connected to the reference signal filter 3, the coefficient stabilization processing unit 6, and a detection device 300. The filter coefficient updating unit 4 calculates a coefficient update value ΔW(n) on the basis of a reference signal r(n) from the reference signal filter 3, an error signal e(n) from the detection device 300, and a predetermined step size, and outputs the coefficient update value ΔW(n) to the coefficient stabilization processing unit 6. The coefficient update value ΔW(n) is provided for updating the control filter coefficient sequence W(n) of the control signal filter 2.

The coefficient stabilization processing unit 6 is connected to the control signal filter 2 and the filter coefficient updating unit 4. The coefficient stabilization processing unit 6 performs a stabilizing process on the coefficient update value Δ W(n) from the filter coefficient updating unit 4 in accordance with a control frequency f(n) inputted to the active noise control apparatus 101, thereby generating a stabilized coefficient update value ΔW'(n). The coefficient stabilization processing unit 6 outputs the stabilized coefficient update value ΔW'(n) to the control signal filter 2.

The control signal filter 2 is connected to the sound source signal generating unit 1, the coefficient stabilization processing unit 6, and an output device 200. The control signal filter 2 updates the control filter coefficient sequence W(n) by adding the stabilized coefficient update value ΔW'(n) from the coefficient stabilization processing unit 6 to the control filter coefficient sequence W(n). Further, the output of the control signal filter 2 is used as a control signal g(n) and is inputted to the output device 200.

Figure 7:
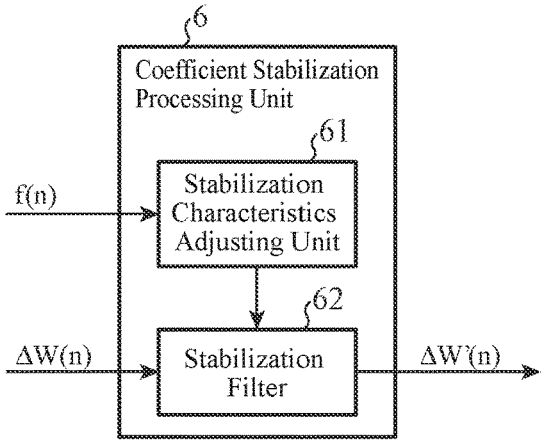
FIG. 7 is a block diagram showing the configuration of a coefficient stabilization processing unit in the active noise control apparatus according to Embodiment 2.

FIG. 7 is a block diagram showing the internal configuration of the coefficient stabilization processing unit 6 in the active noise control apparatus 101 according to Embodiment 2. As illustrated in the drawing, the coefficient stabilization processing unit 6 according to Embodiment 2 includes a stabilization characteristics adjusting unit 61 and a stabilization filter 62.

The stabilization characteristics adjusting unit 61 adjusts the filter characteristics of the stabilization filter 62 in accordance with the value of the control frequency f(n). An instruction for adjusting the filter characteristics is sent from this stabilization characteristics adjusting unit 61 to the stabilization filter 62.

The stabilization filter 62 performs a filtering process on the coefficient update value ΔW(n) outputted by the filter coefficient updating unit 4, thereby outputting the stabilized coefficient update value ΔW'(n). The stabilization filter 62 adjusts the filter characteristics in accordance with the instruction from the stabilization characteristics adjusting unit 61.

Figure 8:
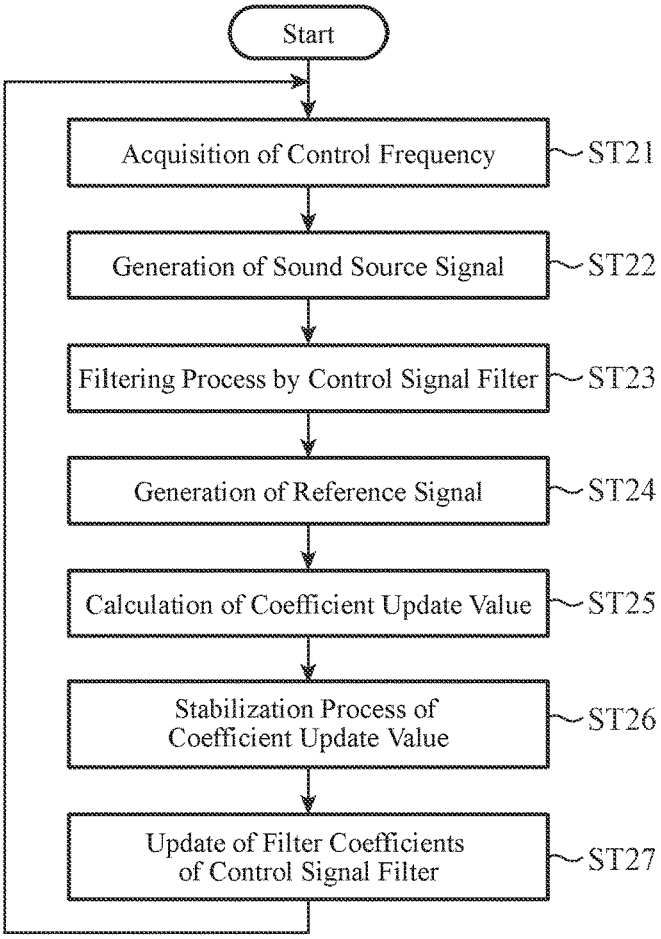
FIG. 8 is a flowchart showing the operation of the active noise control apparatus according to Embodiment 2.

Next, the operation of the active noise control apparatus 101 according to Embodiment 2 will be explained. FIG. 8 is a flowchart showing the operation of the active noise control apparatus 101 according to Embodiment 2. The order of processes performed by the active noise control apparatus 101 according to Embodiment 2 is not limited to that shown in the flowchart of FIG. 8, and the processes can be performed in a different order and a part of the processes can be performed in parallel as long as an equivalent result can be acquired.

A control frequency f(n) showing the frequency of noise is inputted to the sound source signal generating unit 1 and the coefficient stabilization processing unit 6 in the active noise control apparatus 101. As described before, n represents a positive integer, and shows a sampling time in digital signal processing.

In step ST21, the sound source signal generating unit 1 acquires the control frequency f(n).

In step ST22, the sound source signal generating unit 1 generates a sound source signal x(n) corresponding to the control frequency f(n), and outputs the sound source signal x(n) to the control signal filter 2 and the reference signal filter 3.

In step ST23, the control signal filter 2 performs a filtering process on the sound source signal x(n) outputted from the sound source signal generating unit 1 by using the control filter coefficient sequence W(n), thereby outputting the control signal g(n) to the output device 200.

In step ST24, the reference signal filter 3 performs a filtering process on the sound source signal x(n) outputted from the sound source signal generating unit 1 by using a reference filter coefficient sequence C having the transfer characteristics of a secondary path 500, thereby outputting the reference signal r(n) to the filter coefficient updating unit 4.

In step ST25, the filter coefficient updating unit 4 calculates an update value of the control filter coefficient sequence W(n) of the control signal filter 2 on the basis of the reference signal r(n) outputted from the reference signal filter 3, the error signal e(n) outputted from the detection device 300, and the predetermined step size, in such a way that the remaining noise included in the error signal e(n) is reduced, and outputs, as a coefficient update value ΔW(n), the calculated update value to the coefficient stabilization processing unit 6. At this time, when disturbance from the disturbance source 600 is added to the error signal e(n), an inappropriate component caused by the influence of the disturbance is included in the coefficient update value ΔW(n).

In step ST26, the coefficient stabilization processing unit 6 performs a stabilizing process corresponding to the control frequency f(n) on the coefficient update value ΔW(n) outputted from the filter coefficient updating unit 4 to remove the inappropriate component caused by the influence of the disturbance, thereby generating a stabilized coefficient update value ΔW'(n) which causes the control signal g(n) to become stable. The coefficient stabilization processing unit 6 outputs the stabilized coefficient update value ΔW'(n) generated thereby to the control signal filter 2.

In step ST27, the control signal filter 2 updates the control filter coefficient sequence W(n) by adding the stabilized coefficient update value ΔW' (n) outputted from the coefficient stabilization processing unit 6 to the control filter coefficient sequence W(n).

Hereafter, the details of the processes of steps ST26 which are performed by the stabilization characteristics adjusting unit 61 and the stabilization filter 62 of the coefficient stabilization processing unit 6 will be explained.

When the control frequency f(n) increases, a time variation in the noise becomes faster accordingly in many cases. Therefore, the stabilization characteristics adjusting unit 61 adjusts the passband in accordance with the value of the control frequency f(n) when adjusting the filter characteristics of the stabilization filter 62. For example, in a case in which the stabilization filter 62 has low-pass characteristics, the stabilization characteristics adjusting unit 61 provides an instruction to use a filter coefficient sequence which causes the cutoff frequency of the low-pass characteristics to become higher with increase in the control frequency f(n) for the stabilization filter 62. As a result, the followability to noise is ensured.

The stabilization filter 62 performs a filtering process on the coefficient update value ΔW(n) from the filter coefficient updating unit 4 by using the filter coefficient sequence which the stabilization filter is instructed to use by the stabilization characteristics adjusting unit 61, thereby outputting a stabilized coefficient update value ΔW'(n).

Figure 9:
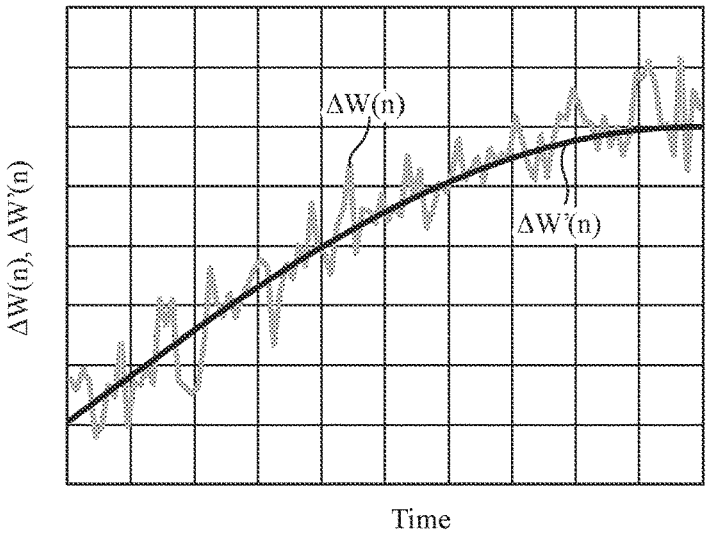
FIG. 9 is a graph showing a time transition of a coefficient update value before a filtering process by the coefficient stabilization processing unit, and a time transition of a stabilized coefficient update value after the filtering process, in Embodiment 2.

FIG. 9 is an example of a graph showing a time transition in the coefficient update value ΔW(n) calculated by the filter coefficient updating unit 4, and a time transition in the stabilized coefficient update value ΔW'(n) which the coefficient stabilization processing unit 6 acquires by performing the filtering process on the coefficient update value ΔW(n). As illustrated in the drawing, in the coefficient update value ΔW(n) before the filtering process by the stabilization filter 62, a finely time-varying fluctuation appears. This variation is an inappropriate component which is caused by disturbance, and only moves finely in upward and downward directions on the graph and does not contribute to noise reduction. The stabilization filter 62 removes such an inappropriate component by using its low-pass characteristics, and outputs the stabilized coefficient update value ΔW'(n) which is stable as shown in the drawing. As a result, the appearing of abnormal noise in the control signal g(n) is prevented.

The active noise control apparatus 101 according to Embodiment 2 can be implemented by hardware for dedicated use which employs an ASIC or the like, a processor that executes a program stored in a memory, or a combination of hardware, such as an electronic circuit or an LSI, and a processor that executes a program stored in a memory, like the active noise control apparatus 100 according to Embodiment 1.

Further, the stabilization filter 62 can be implemented by an analog filter or a digital filter.

As described above, the active noise control apparatus 101 according to Embodiment 2 is configured to include: a sound source signal generating unit 1 generating a sound source signal x(n) on a basis of a control frequency f(n) which is determined in accordance with a noise source 400 emitting noise; a control signal filter 2 generating a control signal g(n) by performing a filtering process on the sound source signal x(n); a reference signal filter 3 generating a reference signal r(n) by performing a filtering process on the sound source signal x(n); a filter coefficient updating unit 4 calculating a coefficient update value ΔW(n) to be used for an update of a filter coefficient sequence W(n) of the control signal filter 2, by using an error signal e(n) which is acquired as a result of interference between a secondary noise which is generated on a basis of the control signal g(n) and the noise, and the reference signal r(n); and a coefficient stabilization processing unit 6 performing a filtering process on the coefficient update value ΔW(n) in such a way that the control signal filter 2 has characteristics of allowing a signal in a frequency band including the control frequency f(n) to pass through, and blocking a signal in a frequency band including disturbance added to the noise, for a signal being included in the sound source signal x(n). With this configuration, an abnormal noise component included in the control signal g(n) can be removed without adding a delay to the control signal g(n). Therefore, the abnormal noise caused by the disturbance can be suppressed without impairing the effect of silencing the noise.

Embodiment 3

In Embodiment 3, in a case where the frequency of noise changes rapidly, by moderating the stabilizing process in accordance with the frequency of the noise, it becomes possible for a control signal g(n) to follow the change promptly.

Figure 10:
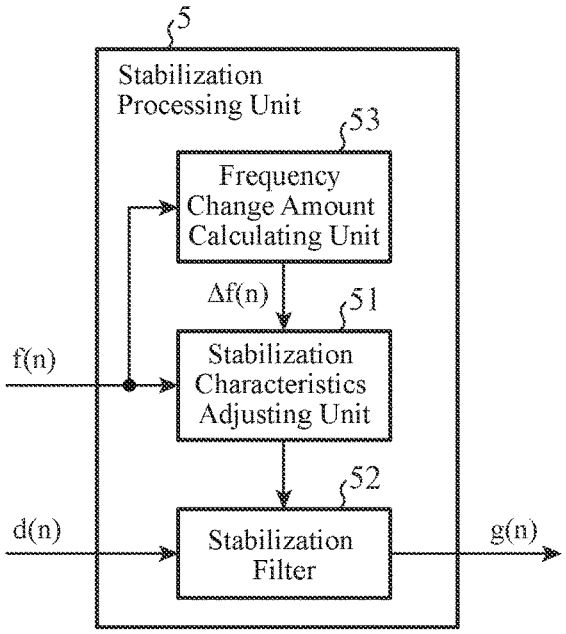
FIG. 10 is a block diagram showing the configuration of a stabilization processing unit in an active noise control apparatus according to Embodiment 3 of the present invention.

An active noise control apparatus 100 according to Embodiment 3 has the same configuration on the drawing as the active noise control apparatus 100 according to Embodiment 1 shown in FIG. 1, and only the internal configuration of the stabilization processing unit 5 is different to that in Embodiment 1. A block diagram of the stabilization processing unit 5 in the active noise control apparatus 100 according to Embodiment 3 is shown in FIG. 10. As illustrated in the drawing, the stabilization processing unit 5 according to Embodiment 3 includes a stabilization characteristics adjusting unit 51, a stabilization filter 52, and a frequency change amount calculating unit 53.

Figure 11:
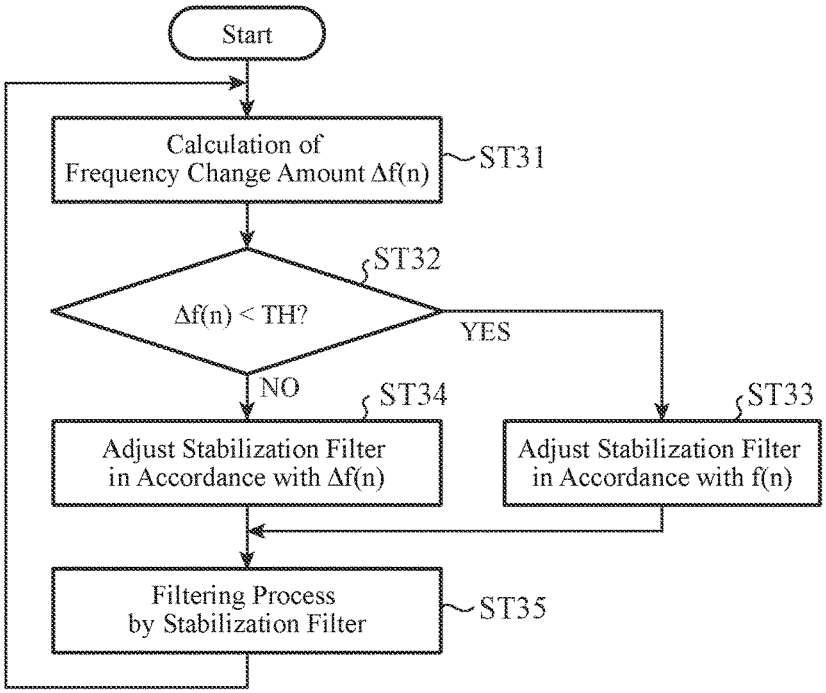
FIG. 11 is a flowchart showing the operation of the stabilization processing unit in the active noise control apparatus according to Embodiment 3.

FIG. 11 is a flowchart showing the operation of the stabilization processing unit 5 according to Embodiment 3. The order of processes performed by the stabilization processing unit 5 according to Embodiment 3 is not limited to that shown in the flowchart of FIG. 11, and the processes can be performed in a different order and a part of the processes can be performed in parallel as long as an equivalent result can be acquired.

The processes shown in the flowchart of FIG. 11 are the process performed in step ST14 in the flowchart of FIG. 3.

In step ST31, the frequency change amount calculating unit 53 calculates an amount of temporal change in a control frequency f(n) by using the control frequency f(n), and outputs, as a frequency change amount Δf(n), the amount of temporal change to the stabilization characteristics adjusting unit 51.

The frequency change amount Δf(n) is calculated by using, for example, the following equation (1). In the equation, a represents a real number which satisfies $0 \leq \alpha < 1$.

$$\Delta f(n) = \alpha \times \Delta f(n-1) + (1-\alpha) \times (f(n) - f(n-1)) \quad (1)$$

In step ST32, the stabilization characteristics adjusting unit 51 compares the frequency change amount Δf(n) outputted from the frequency change amount calculating unit 53 with a predetermined threshold TH. The predetermined threshold TH is determined heuristically on the basis of an experiment or the like, and is preset to the stabilization characteristics adjusting unit 51.

When $\Delta f(n)<TH$ (when "YES" in step ST32), the stabilization characteristics adjusting unit 51 advances to step ST33, whereas when $\Delta f(n)\geq TH$ (when "NO" in step ST32), the stabilization characteristics adjusting unit 51 advances to step ST34.

In step ST33, the stabilization characteristics adjusting unit 51 adjusts the filter characteristics of the stabilization filter 52 on the basis of the control frequency f(n). It is assumed that the method of adjusting the filter characteristics in this case is the same as that according to Embodiment 1.

In step ST34, the stabilization characteristics adjusting unit 51 adjusts the filter characteristics of the stabilization filter 52 on the basis of the frequency change amount $\Delta f(n)$. For example, when the stabilization filter 52 has low-pass characteristics, the stabilization characteristics adjusting unit 51 adjusts the stabilization filter 52 in such a way that the stabilization filter has low-pass characteristics in which the cutoff frequency becomes higher with increase in the frequency change amount $\Delta f(n)$. As a result, since when the frequency of the noise changes largely, the passband of the stabilization filter 52 is widened and the stabilizing process is moderated, it becomes possible for a control signal g(n) to follow the noise changing rapidly.

In step ST35, the stabilization filter 52 performs a filtering process on an original control signal d(n) in accordance with the filter characteristics adjusted by the stabilization characteristics adjusting unit 51, thereby outputting the control signal g(n).

As described above, in the configuration according to Embodiment 3, a frequency change amount calculating unit 53 calculates a frequency change amount $\Delta f(n)$ showing an amount of temporal change in the control frequency f(n), and when the frequency change amount $\Delta f(n)$ is less than a predetermined threshold TH, the stabilization characteristics adjusting unit 51 adjusts the stabilization filter 52 in such a way that the frequency band including the control frequency f(n) is a passband, and when the frequency change amount $\Delta f(n)$ is equal to or greater than the predetermined threshold TH, the stabilization characteristics adjusting unit 51 adjusts the stabilization filter 52 in such a way that the stabilization filter 52 has low-pass characteristics in which an upper cutoff frequency becomes higher with increase in the frequency change amount $\Delta f(n)$. With this configuration, the followability of the active noise control apparatus 100 for a change in the frequency of noise can be maintained.

The stabilizing process according to Embodiment 3 may be applied to the coefficient stabilization processing unit 6 of the active noise control apparatus 101 according to Embodiment 2. In this case, the active noise control apparatus 101 according to Embodiment 3 has the same configuration on the drawing as the active noise control apparatus 101 according to Embodiment 2 shown in FIG. 6, and only the internal configuration of the coefficient stabilization processing unit 6 is different to that in Embodiment 2.

Figure 12:
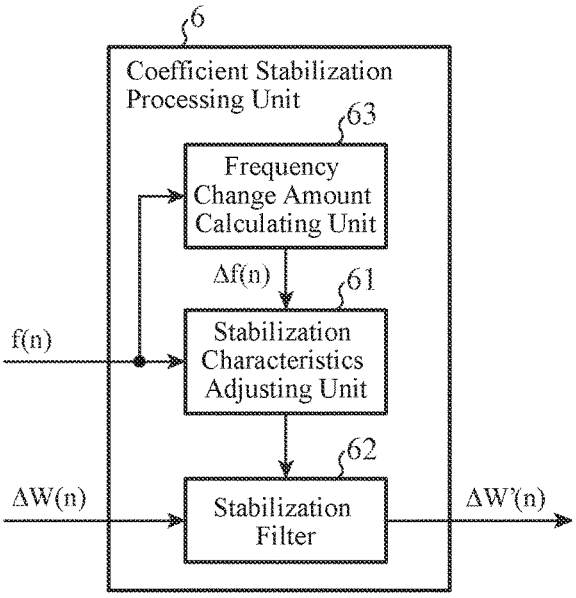
FIG. 12 is a flowchart showing the operation of a coefficient stabilization processing unit in the active noise control apparatus according to Embodiment 3.

A block diagram of the coefficient stabilization processing unit 6 in the active noise control apparatus 101 according to Embodiment 3 is shown in FIG. 12. As illustrated in the drawing, the coefficient stabilization processing unit according to Embodiment 3 includes a stabilization characteristics adjusting unit 61, a stabilization filter 62, and a frequency change amount calculating unit 63.

The frequency change amount calculating unit 63 calculates an frequency change amount $\Delta f(n)$ showing an amount of temporal change in the control frequency f(n) by using the control frequency f(n), and outputs the frequency change amount $\Delta f(n)$ to the stabilization characteristics adjusting unit 61.

When the frequency change amount $\Delta f(n)$ outputted from the frequency change amount calculating unit 63 is less than a predetermined threshold TH, the stabilization characteristics adjusting unit 61 adjusts the filter characteristics of the stabilization filter 62 in such a way that its passband changes in accordance with the value of the control frequency f(n), like that according to Embodiment 2.

In contrast, when the frequency change amount $\Delta f(n)$ is equal to or greater than the predetermined threshold TH, the stabilization characteristics adjusting unit 61 moderates the stabilizing process by adjusting the filter characteristics of the stabilization filter 62 in such a way that the stabilization filter has low-pass characteristics in which the upper cutoff frequency becomes higher with increase in the frequency change amount $\Delta f(n)$.

With this configuration, the followability of the active noise control apparatus 101 for a change in the frequency of noise can be maintained.

Regarding the present invention, it is to be understood that any combination of the above-described embodiments can be made, any component of anyone of the embodiments can be changed or omitted within the scope of the invention.

INDUSTRIAL APPLICABILITY

The active noise control apparatus according to the present invention generates noise for cancelling out noise which is generated by machinery, for example, thereby reducing the noise, and is suitable for use as an active noise control apparatus that reduces the noise which is, for example, emitted by the engine of a vehicle.

REFERENCE SIGNS LIST

1 sound source signal generating unit, 2 control signal filter, 3 reference signal filter, 4 filter coefficient updating unit, 5 stabilization processing unit, 6 coefficient stabilization processing unit, 51 and 61 stabilization characteristics adjusting unit, 52 and 62 stabilization filter, 53 and 63 frequency change amount calculating unit, 100 and 101 active noise control apparatus, 200 output device, 300 detection device, 400 noise source, 500 secondary path, 600 disturbance source, 1001 processor, 1002 memory, 1003 input/output interface, and 1004 bus.

The invention claimed is:

1. An active noise control apparatus comprising:

a sound source signal generator generating a sound source signal on a basis of a control frequency which is determined in accordance with a noise source emitting noise;

a control signal filter generating an original control signal by performing a filtering process on the sound source signal;

a stabilization processor generating a control signal by performing a filtering process on the original control signal to allow a signal in a frequency band including the control frequency to pass through, and to block a signal in a frequency band including disturbance added to the noise;

a reference signal filter generating a reference signal by performing a filtering process on the sound source signal; and a filter coefficient updater updating a filter coefficient sequence of the control signal filter by using an error signal which is acquired as a result of interference between a secondary noise which is generated on a basis of the control signal and the noise, and the reference signal.

2. The active noise control apparatus according to claim 1, wherein the stabilization processor includes:

a stabilization filter generating the control signal by performing a filtering process on the original control signal; and a stabilization characteristics adjuster adjusting the stabilization filter in such a way that the frequency band including the control frequency is a passband.

3. The active noise control apparatus according to claim 2, wherein the stabilization processor has a frequency change amount calculator calculating a frequency change amount showing an amount of temporal change in the control frequency, and wherein when the frequency change amount is less than a predetermined threshold, the stabilization characteristics adjuster adjusts the stabilization filter in such a way that the frequency band including the control frequency is a passband, and when the frequency change amount is equal to or greater than the predetermined threshold, the stabilization characteristics adjuster adjusts the stabilization filter in such a way that the stabilization filter has low-pass characteristics in which an upper cutoff frequency becomes higher with increase in the frequency change amount.

4. An active noise control apparatus comprising:

a sound source signal generator generating a sound source signal on a basis of a control frequency which is determined in accordance with a noise source emitting noise;

a control signal filter generating a control signal by performing a filtering process on the sound source signal;

a reference signal filter generating a reference signal by performing a filtering process on the sound source signal;

a filter coefficient updater calculating a coefficient update value to be used for an update of a filter coefficient sequence of the control signal filter, by using an error signal which is acquired as a result of interference between a secondary noise which is generated on a basis of the control signal and the noise, and the reference signal; and a coefficient stabilization processor performing a filtering process on the coefficient update value in such a way that the control signal filter has characteristics of allowing a signal in a frequency band including the control frequency to pass through, and blocking a signal in a frequency band including disturbance added to the noise, for a signal being included in the sound source signal.

5. The active noise control apparatus according to claim 4, wherein the coefficient stabilization processor includes:

a stabilization filter performing a filtering process on the coefficient update value; and a stabilization characteristics adjuster adjusting the stabilization filter in such a way that a passband changes in accordance with a value of the control frequency.

6. The active noise control apparatus according to claim 5, wherein the coefficient stabilization processor has a frequency change amount calculator calculating a frequency change amount showing an amount of temporal change in the control frequency, and wherein when the frequency change amount is less than a predetermined threshold, the stabilization characteristics adjuster adjusts the stabilization filter in such a way that the passband changes in accordance with the value of the control frequency, and when the frequency change amount is equal to or greater than the predetermined threshold, the stabilization characteristics adjuster adjusts the stabilization filter in such a way that the stabilization filter has low-pass characteristics in which an upper cutoff frequency becomes higher with increase in the frequency change amount.

* * * * *